US005165464A

United States Patent [19]

Donahue et al.

[11] Patent Number: 5,165,464

[45] Date of Patent: Nov. 24, 1992

[54] METHOD OF CASTING HYPEREUTECTIC ALUMINUM-SILICON ALLOYS USING A SALT CORE

[75] Inventors: Raymond J. Donahue, Fond du Lac; William G. Hesterberg, Rosendale; Terrance M. Cleary, Allenton; Lawrence I. Toriello, Fond du Lac, all of Wis.

[73] Assignee: Brunswick Corporation, Skokie, Ill.

[21] Appl. No.: 767,260

[22] Filed: Sep. 27, 1991

[51] Int. Cl.[5] ..... B22D 17/00

[52] U.S. Cl. ..... 164/113; 164/522

[58] Field of Search ..... 164/113, 132, 522

[56] References Cited

U.S. PATENT DOCUMENTS 4,603,665 8/1986 Hesterberg et al. ..... 123/195
4,821,694 4/1989 Hesterberg et al. ..... 123/195
4,875,517 10/1989 Donahue et al. ..... 164/34
4,966,220 10/1990 Hesterberg ..... 164/34
4,969,428 11/1990 Donahue et al. ..... 123/195

*Primary Examiner*—Kuang Y. Lin
*Attorney, Agent, or Firm*—Andrus, Sceales, Starke & Sawall

[57] ABSTRACT

A method of high pressure casting of hypereutectic aluminum-silicon alloys using a salt core to form wear resistant articles, such as engine blocks. To produce an engine block, one or more solid salt cores are positioned within a metal mold with the space between the cores and the mold defining a die cavity. A molten hypereutectic aluminum-silicon alloy containing more than 12% silicon is fed into the die cavity and on solidification of the molten alloy, precipitated silicon crystals are formed, which are distributed throughout the wall thickness of the cast part and also on the surface bordering the salt cores which constitute the cylinder bores in the cast block. The salt cores are subsequently removed from the cast block by contact with a solvent such as water.

10 Claims, No Drawings

METHOD OF CASTING HYPEREUTECTIC ALUMINUM-SILICON ALLOYS USING A SALT CORE

BACKGROUND OF THE INVENTION

It has long been recognized that the lighter weight and better heat transfer properties make aluminum alloys the logical choice as a material for internal combustion engine blocks. However, most aluminum alloys lack wear resistance and it has been customary in the past to chromium plate the cylinder bores in the engine block with abrasion resistant coatings such as chromium, or alternately, to apply cast iron liners to the bores. It is difficult to uniformly plate the cylinder bores and as a result, plating is an expensive operation, and in the case of chromium plating, not environmentally friendly. The use of cast iron liners increases the overall cost of the engine block, as well as the weight of the engine.

Hypereutectic aluminum-silicon alloys, containing more than I2% by weight of silicon, possess good wear resistance achieved by the precipitated silicon crystals which constitute the primary phase. Because of the wear resistance, attempts have been made to use hypereutectic aluminum-silicon alloys as casting alloys for engine blocks to eliminate the need for plated or lined cylinder bores.

Typical wear resistant aluminum-silicon alloys are described in U.S. Pat. Nos. 4,603,665 and 4,969,428. U.S. Pat. No. 4,603,665 describes a hypereutectic aluminum-silicon casting alloy having particular use in casting engine blocks for marine engines. The alloy of that patent is composed by weight of 16% to 19% silicon, 0.4% to 0.7% magnesium, less than 0.37% copper, and the balance aluminum. The alloy has a narrow solidification range providing the alloy with excellent castability, and as the copper content is maintained at a minimum, the alloy has improved resistance to salt water corrosion.

U.S. Pat. No. 4,969,428 is directed to a hypereutectic aluminum-silicon alloy containing in excess of 20% by weight of silicon and having an improved distribution of primary silicon in the microstructure. Due to the high silicon content in the alloy, along with the uniform distribution of the primary silicon in the microstructure, improved wear resistance is achieved.

High pressure die casting operations have generally been used in the past to cast engine blocks. In a high pressure die casting operation, pressures in excess of 5000 psi are normally encountered and metal molds and cores are employed. Due to the high metallostatic pressures associated with high pressure die casting, conventional bonded sand cores are difficult to apply in general and cannot be employed where size exceeding 10 cubic inches is involved in conjunction with modest or major geometric shape complexity, because they do not have the strength to withstand the high pressures.

It has been found that when using high pressure die casting operations to cast engine blocks from hypereutectic aluminum-silicon alloys using a metal mold and metal core, a denuded zone, free of primary silicon, is formed at the as cast surface, because of the rapid heat extraction through the metal core. As the cylindrical surface bordering the metal core constitutes the cylinder bore in the cast engine block, the denuded condition adversely effects the wear resistance of the cylinder bore. Because of this, it has been the practice to remove up to 0.060 inch from the bore by expensive stock removal procedures, and even with the removal of that thickness, the volume fraction of primary silicon is often less than that predicted by the phase diagram. A cylinder bore with a low volume fraction of primary silicon can cause field failure of the engine, due to the decreased wear resistance.

SUMMARY OF THE INVENTION

The invention is directed to an improved method of high pressure casting of hypereutectic aluminum-silicon alloys which will eliminate denuded zones, free of primary silicon, at the wear resistant surface. The invention has particular application in casting engine blocks containing one or more cylinder bores.

In accordance with the invention, a salt core formed of a salt, such as sodium chloride, is spaced within an outer metal mold, with the space between the salt core and the mold defining a die cavity. A molten hypereutectic aluminum silicon alloy containing in excess of 12% silicon, and preferably in the range of 17% to 30% silicon, is introduced into the die cavity under high pressure, generally above 5000 psi. On solidification of the molten alloy, the silicon will precipitate as silicon crystals which will be distributed throughout the wall thickness of the cast part, as well as along the surface bordering the salt core. The salt core, having a low coefficient of thermal conductivity, will not extract heat from the molten metal fast enough to suppress the formation of primary silicon, and as a result there is no detrimental denuded zone adjacent the salt core that forms the cylinder bore.

With the use of the invention, engine blocks can be produced with bores that have a uniform distribution of primary silicon at the original as-cast surface and throughout the wall thickness of the casting. As there is no denuded zone free of primary silicon, expensive special stock removal procedures, as used in the past, are not required.

Further, the use of a salt core results in economic advantages over the use of metal cores, which must be designed to be split or collapsible in order to be removed from the cast block.

Other objects and advantages will appear in the course of the following description.

DESCRIPTION OF THE PREFERRED EMBODIMENT

The invention is directed to a method of high pressure casting of wear resistant components from a hypereutectic aluminum-silicon alloy, and has particular application to casting engine blocks for marine engines. The casting alloy is a hypereutectic aluminum-silicon alloy containing more than 12% silicon. The alloy contains precipitated primary silicon particles or crystals that are distributed throughout the cast part.

In general, the aluminum-silicon alloy contains by weight from 12% to 30% silicon, 0.4% to 1.0% magnesium, less than 1.45% iron, less than 0.3% manganese, less than 0.37% copper, and the balance aluminum.

More particularly the casting alloy can be composed of an aluminum-silicon alloy as described in U.S. Pat. No. 4,969,428 having the following composition in weight percent:

| | |
|---|---|
| Silicon | 20.0%-30.0% |
| Magnesium | 0.4%-1.6% |

-continued

| | |
|---|---|
| Iron | Less than 1.45% |
| Manganese | Less than 0.30% |
| Copper | Less than 0.25% |
| Aluminum | Balance |

Alternately the casting alloy can be a hypereutectic aluminum-silicon alloy as described in U.S. Pat. No. 4,821,694 having the following composition in weight percent:

| | |
|---|---|
| Silicon | 16.0–19.0% |
| Magnesium | 0.4%–0.7% |
| Iron | Less than 1.4% |
| Manganese | Less than 0.3% |
| Copper | Less than 0.37% |
| Aluminum | Balance |

The silicon, being present as discrete precipitated particles or crystals, contributes to the wear resistance of the alloy.

The magnesium acts to strengthen the alloy through age hardening, while the iron and manganese tend to harden the alloy, decrease its ductility, increase its machinability, and aid in maintaining the mechanical properties of the alloy at elevated temperatures.

By minimizing the copper content, the corrosion resistance of the alloy to salt water environments is greatly improved.

The alloy can also contain small amounts, up to about 0.2% each, of residual hardening elements, such as nickel, chromium, zinc or titanium.

In accordance with the invention, the outer mold used in the high pressure die casting operation, is formed of a metal, such as steel, and a salt core is employed. The salt to be used as the core has a melting point generally above 1200° F and higher than the melting point of the casting metal, and the salt should be soluble in a solvent which will not attack the cast metal. For most applications, a material such as sodium chloride is preferred as the salt, because it is inexpensive, readily available and can be solubilized from the metal part by water.

The salt core can be produced by an evaporable foam casting process, as disclosed in U.S. Pat. No. 4,875,517. As disclosed in that patent, an evaporable foam pattern is formed of a material such as polystyrene and has a shape identically proportional to that of the salt core to be produced. The foam pattern is placed in a mold and surrounded with an unbonded flowable material, such as sand. Molten salt, such as sodium chloride, at a temperature generally in the range of about 1250° F. to 1400° F., is then introduced into the mold via a sprue and into contact with the evaporable foam pattern. The heat of the molten salt vaporizes the pattern, with the vapor being trapped in the interstices of the sand, while the molten salt fills the void created by vaporization of the pattern to produce a salt core identical in configuration to the evaporable foam pattern.

In the high pressure die casting operation of the invention, the salt core is positioned in a mold and spaced from the mold to provide a die cavity. When casting engine blocks, one or more salt cores are utilized which form the cylinder bores in the cast block. The cores are spaced inwardly of the metal mold to define the die cavity.

The molten aluminum-silicon alloy is then introduced into the die cavity at a high pressure, generally in the range of about 5,000 to 20,000 psi, and preferably about 10,000 psi.

On solidification of the molten metal, primary silicon will be precipitated and as the salt cores have a relatively low coefficient of thermal conductivity, generally about 9 $Wm^{-1}K^{-1}$, the insulating effect of the cores will prevent rapid extraction of heat from the molten metal to thereby enable primary silicon crystals to be precipitated at the interface with the cores. As a result there is no detrimental denuded zone adjacent the salt cores that form the engine bores.

Following the casting operation, the cast part is removed from the die and the salt core is washed from the casting. When using a salt core formed of a material such as sodium chloride, the core is preferably removed by immersing the casting in a wash tank containing water at ambient temperature or at an elevated temperature. The water is agitated, and depending upon the volume of the salt core, it will normally be completely dissolved from the casting in a period of 5 to 30 minutes.

The die cast engine block, or other component, has a uniform distribution of primary silicon at the original as cast surface bordering the salt core and throughout the wall thickness of the casting. As there is no detrimental denuded zone of primary silicon in the engine bores, expensive special stock removal procedures to remove metal from the bores is not required.

In addition to preventing the formation of the denuded zones of primary silicon, the use of the salt cores simplifies the casting procedure and enables the cores to be formed with more complex or complicated configurations than when using metal cores.

Various modes of carrying out the invention are contemplated as being within the scope of the following claims particularly pointing out and distinctly claiming the subject matter which is regarded as the invention.

We claim:

1. A method of casting wear resistance components, comprising the steps of forming an outer metal mold, positioning a salt core in spaced relation within the mold to provide a die cavity between the mold and the salt core, introducing a molten hypereutectic aluminum-silicon alloy into the die cavity at a pressure greater than 5,000 psi, solidifying the molten alloy to provide a cast article with precipitated silicon crystals throughout the wall thickness of the article and at the interface with the salt core, and thereafter removing the salt core from the cast article.

2. The method of claim I, wherein said alloy contains more than 12% silicon.

3. The method of claim 1, wherein said salt core is composed of sodium chloride.

4. The method of claim 1, including the step of feeding the molten alloy into the die cavity at a pressure of 5,000 to 20,000 psi.

5. The method of claim 1, wherein said alloy has the following composition in weight percent:

| | |
|---|---|
| Silicon | 16.0%–19.0% |
| Magnesium | 0.4%–0.7% |
| Iron | Less than 1.4% |
| Manganese | Less than 0.3% |
| Copper | Less than 0.37% |
| Aluminum | Balance. |

6. A method of casting an engine block for an internal combustion engine, comprising the steps of forming an outer metal mold, positioning a plurality of generally cylindrical salt cores within said mold in spaced relation to said mold and to each other to provide a die cavity between said cores and said mold, introducing a molten hypereutectic aluminum-silicon alloy containing more than 12% silicon into said die cavity at a pressure in excess of 5,000 psi solidifying said molten alloy to form a casting with precipitated silicon particles throughout the wall thickness of said casting and at the interface with said salt cores, and thereafter removing said salt cores from said casting to provide a cast block containing a plurality of cylinder bores.

7. The method of claim 6, wherein said alloy has the following composition in weight percent:

| | |
|---|---|
| Silicon | 20.0%-30.0% |
| Magnesium | 0.4%-1.6% |
| Copper | Less than 0.25% |
| Iron | Less than 1.45% |
| Magnesium | Less than 0.30% |
| Aluminum | Balance. |

8. The method of claim 6, wherein the step of removing the salt cores comprises contacting the cores with a solvent for the salt.

9. The method of claim 8, wherein the solvent is water.

10. The method of claim 6, wherein said alloy contains by weight from 12% to 30% silicon, 0.4% to 1.0% magnesium, less than 1.4% iron, less than 0.3% manganese, less than 0.37% copper, and the balance aluminum.

* * * * *